United States Patent [19]

Ray

[11] 4,220,246

[45] Sep. 2, 1980

[54] SHEAVE ADJUSTABLE BALANCE CRANE

[76] Inventor: Louis F. Ray, P.O. Box 14702, Baton Rouge, La. 70808

[21] Appl. No.: 915,848

[22] Filed: Jun. 15, 1978

[51] Int. Cl.[2] ..... B66C 23/06

[52] U.S. Cl. ..... 212/191; 212/198

[58] Field of Search ..... 212/3, 12, 28, 39 R, 212/39 MS, 39 A, 47, 48, 49, 13, 10, 56, 63, 71, 11, 84; 340/267 C; 296/190; 414/138

[56] References Cited

U.S. PATENT DOCUMENTS

| | | | |
|---|---|---|---|
| 3,722,705 | 3/1973 | Gould | 212/49 X |
| 3,752,326 | 8/1973 | Levingston | 212/48 X |
| 3,834,552 | 9/1974 | Lofink | 212/84 X |
| 3,851,767 | 12/1974 | Durand | 212/48 |
| 3,957,165 | 5/1976 | Smith | 296/190 X |
| 4,067,446 | 1/1978 | Ray | 212/48 |
| 4,113,112 | 9/1978 | Ray | 212/48 X |

*Primary Examiner*—Stephen G. Kunin
*Assistant Examiner*—Terrance L. Siemens
*Attorney, Agent, or Firm*—Sughrue, Rothwell, Mion, Zinn and Macpeak

[57] ABSTRACT

A crane structure is mounted on a platform and has a tower assembly with spaced apart columns spanned at their upper extremities by an upper structure. A gantry includes a central section, fixedly secured on the upper structure, and first and second outer gantry sections. The outer sections are pivotally connected to the central section, and are movable between horizontal operating positions and generally vertical transport positions. The gantry sections have at least two vertically spaced series of tracks thereon. In the upper tracks a counterweight is mounted on casters or rollers, and a lift trolley is similarly disposed on the lower tracks. A sheave and winch assembly interconnects the counterweight and the lift trolley through a cable arrangement, whereby corresponding movements of the counterweight and the lift trolley are effected through operation of the winch. The lift trolley is adapted to travel substantially the full lengths of the gantry sections when the sections are in operating positions. An operator's cab is mounted on an arm pivotally secured to one of the columns.

10 Claims, 17 Drawing Figures

FIG. 1
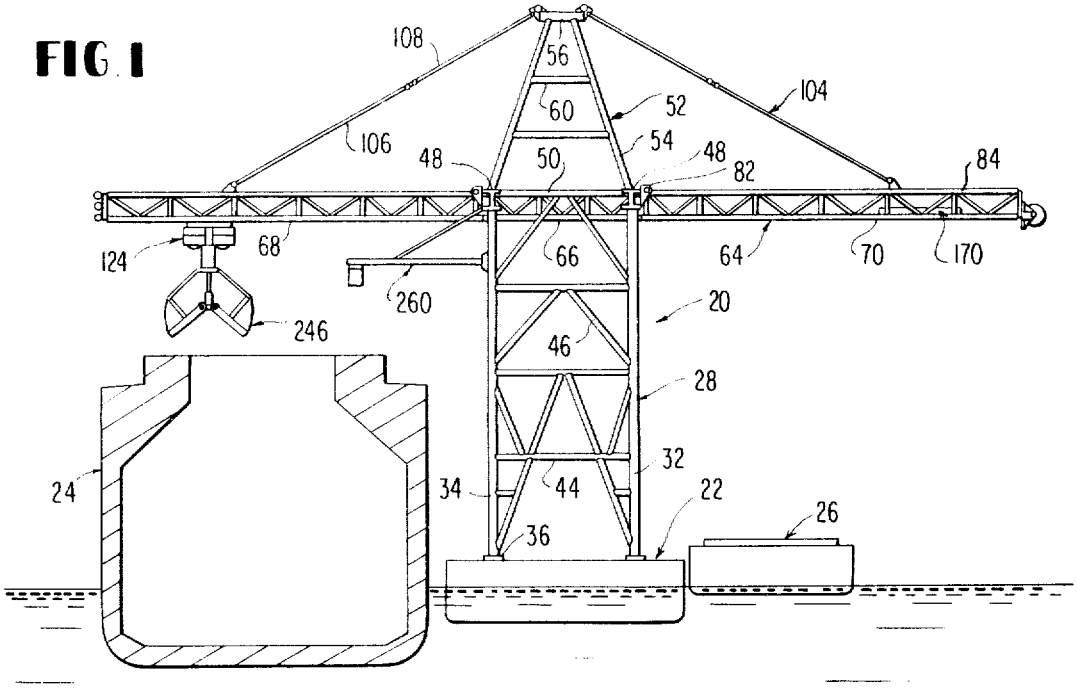
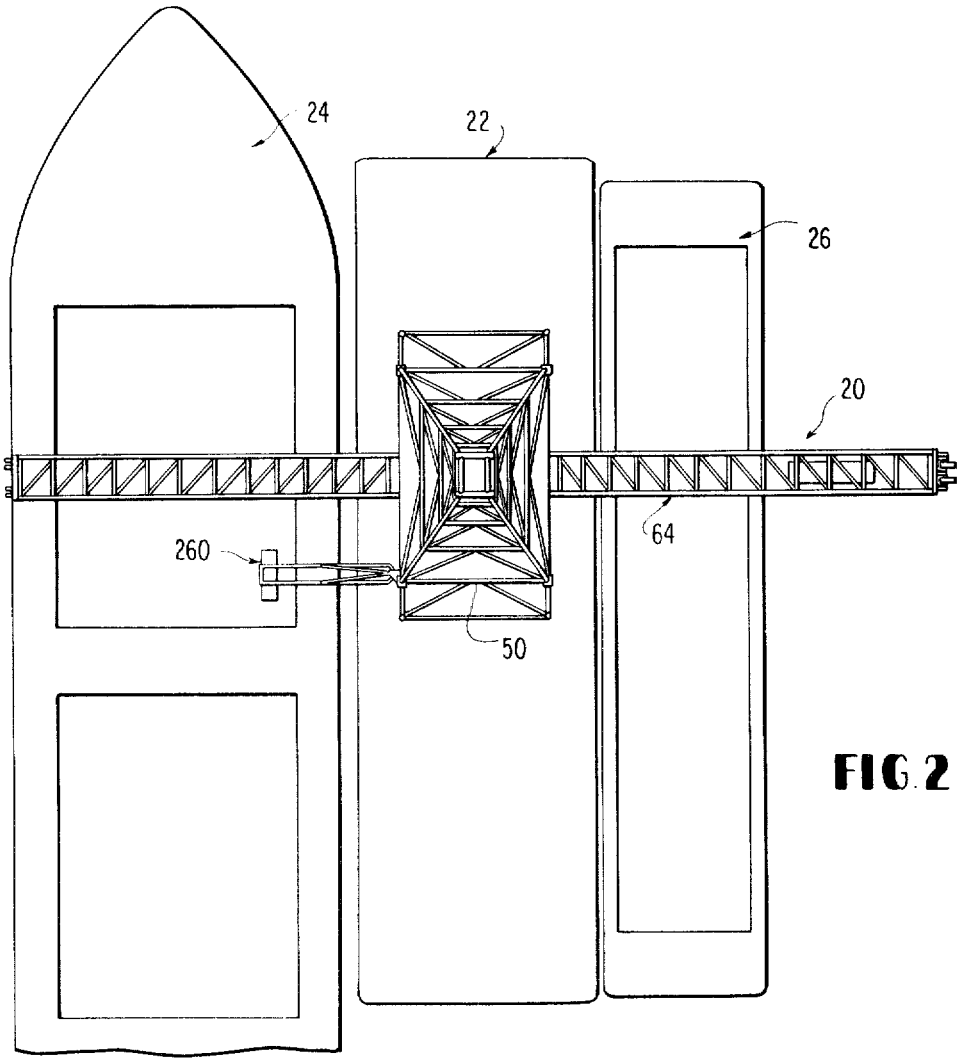
FIG. 2

SHEAVE ADJUSTABLE BALANCE CRANE

BACKGROUND OF THE INVENTION

1. Field of the Invention

This invention relates to cranes of the type employed typically in loading and unloading functions, and to maintenance of balance of the crane to minimize tipping when lifting heavy loads.

2. Description of the Prior Art

The problem of maintenance of balance of lifting and transporting devices has long been recognized. Prior proposals for minimizing the potentially hazardous consequences of positioning a heavy load at one extremity of a crane have included the devices shown in the below listed patents:

PRIOR ART REFERENCES

| PRIOR ART REFERENCES | | |
|---|---|---|
| U.S. Pat. No. | Inventor(s) | Issue Date |
| 3,722,705 | Gould | 3-27-73 |
| 3,752,326 | Levingston | 8-14-73 |
| 3,789,997 | Kozlovsky et al | 2-04-74 |
| 3,845,865 | Campbell et al | 11-05-74 |
| 3,945,508 | Colin | 3-23-76 |
| 3,957,161 | Tax | 5-18-76 |

SUMMARY OF THE INVENTION

The present invention relates to a substantial maintenance of the balance of a crane through a system wherein the position of a movable counterweight is altered in response to the movement of the lift means of the crane. The structure of such a crane includes a tower assembly of substantial weight and mass in relation to the materials to be handled. Extending horizontally through the center of the tower is a gantry assembly with a series of tracks. A counterweight is supported on one series of tracks, and a lift trolley is movably mounted on a separate series of tracks. The weight of the unloaded lift trolley and associated components (such as a load bucket and attendant linkage) is equal to the weight of the counterweight. The counterweight and lift trolley are connected by cable means which are trained about a series of sheaves and connected to a drive winch. As the lift trolley is moved along the gantry assembly in one direction by the winch, the counterweight is simultaneously propelled an equal distance in the opposite direction so that the crane remains balanced. Since the weight of the unloaded lift trolley and associated components is substantially equal to that of the heaviest load to be carried by the bucket, an imbalance occurs upon loading the bucket. However, the tower mass is sufficient to withstand the tilting moment of the bucket after loading; and, if the crane is mounted on a floating barge, the barge will tilt only within acceptable limits.

A further advantage of the construction herein disclosed resides in the provision of means for pivoting of crane to be transported conveniently and to pass through areas with restricted openings, such as occurs in maritime applications where draw spans are encountered.

A novel feature of the crane structure is that the operator's cab is placed on a movable arm on the tower beneath the level of the gantry. By this expedient, the operator's vision is not obstructed by the tower, and the loading or unloading area is readily visible.

The novel crane construction renders the crane easily accessible for service and repair and is relatively inexpensive and non-complex, thereby rendering the cost of manufacture and maintenance below that of conventional devices.

The provision of a central gantry with a bypassing counterweight and lift means avoids the necessity to rotate the gantry during loading and unloading operations and, thereby, further reduces both the cost of original construction and operating expense. This also speeds the functions of the device materially.

Other and further objects and advantages will become apparent to those skilled in the art through a consideration of the following specification when read in conjunction with the annexed drawing.

BRIEF DESCRIPTION OF THE DRAWING

FIG. 1 is an elevational view illustrating a crane assembly according to this invention in a typical environment of employment;

FIG. 2 is a top view of the arrangement shown in FIG. 1;

DESCRIPTION OF THE PREFERRED EMBODIMENT

Figure 3:
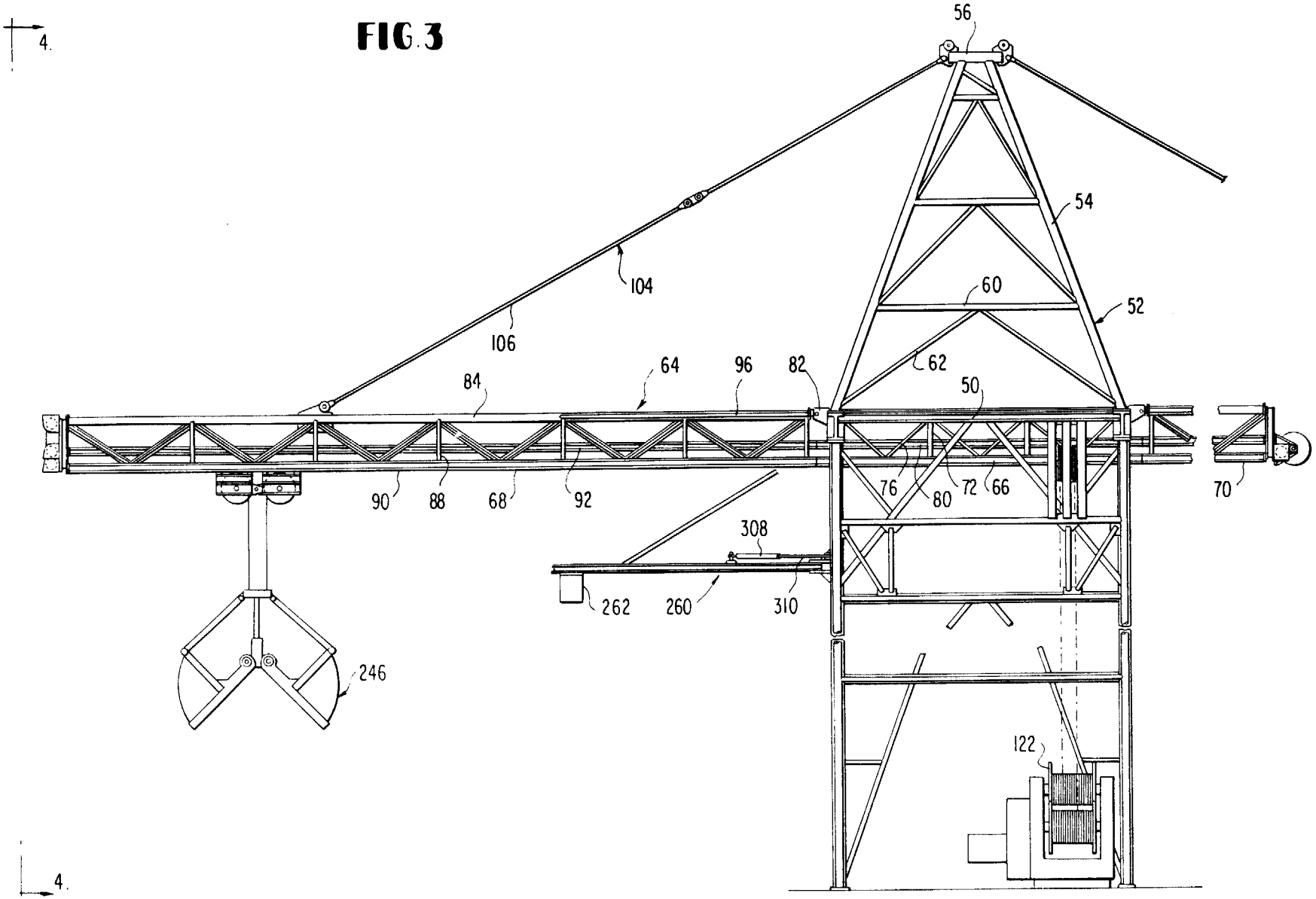
FIG. 3 is an enlarged partial elevation, foreshortened.

In FIGS. 1 and 2, there is shown a crane constructed and assembled in accordance with this invention and generally identified by reference character 20. The crane 20 is, in the environment of use herein disclosed, mounted on a buoyant barge 22 positioned between a vessel 24, to be loaded or unloaded, and another barge 26. The crane 20 is thus employed in transferring materials between vessel 24 and barge 26.

Figure 4:
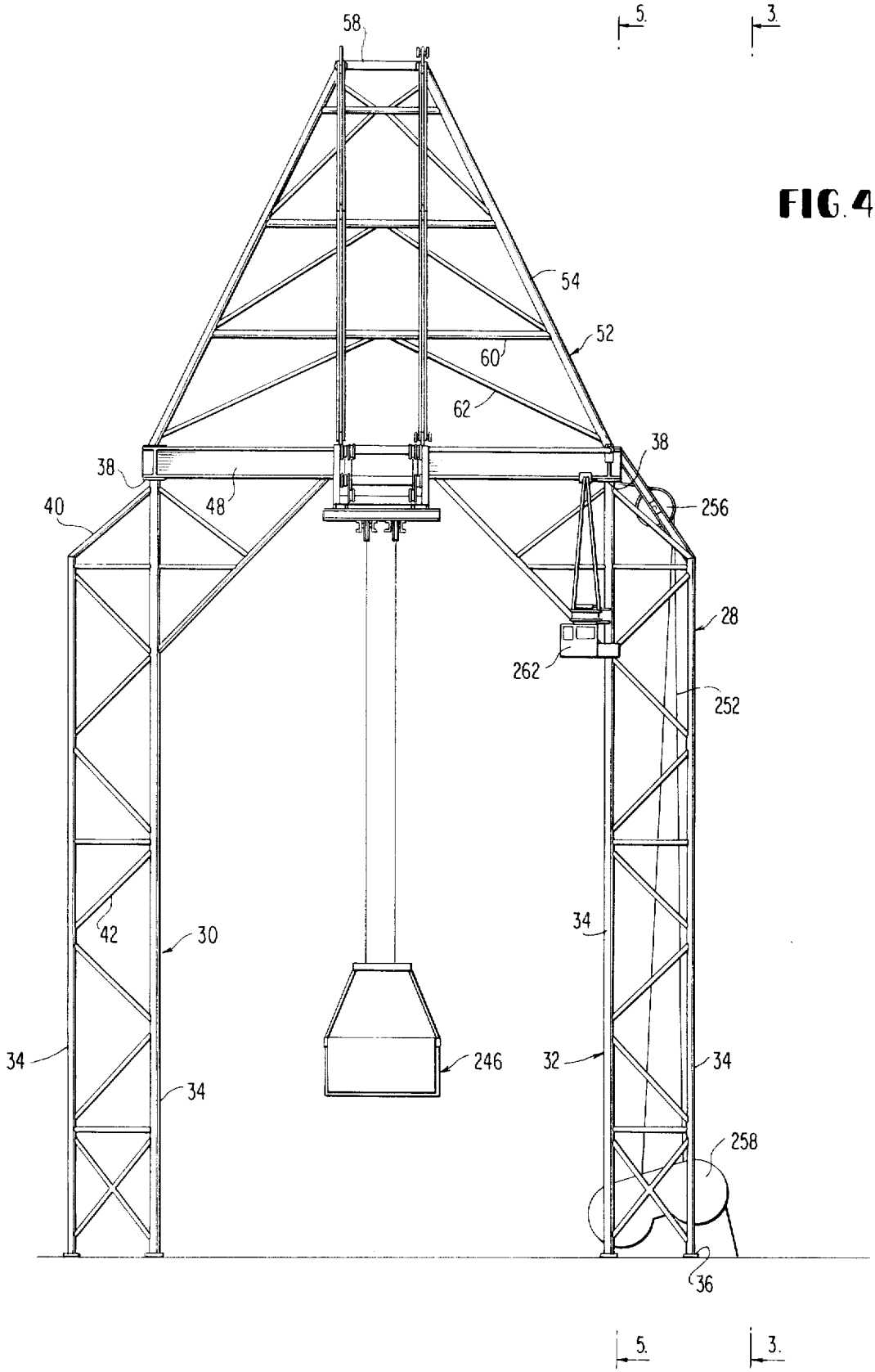
FIG. 4 is an end elevational view of the assembly.
Figure 5:
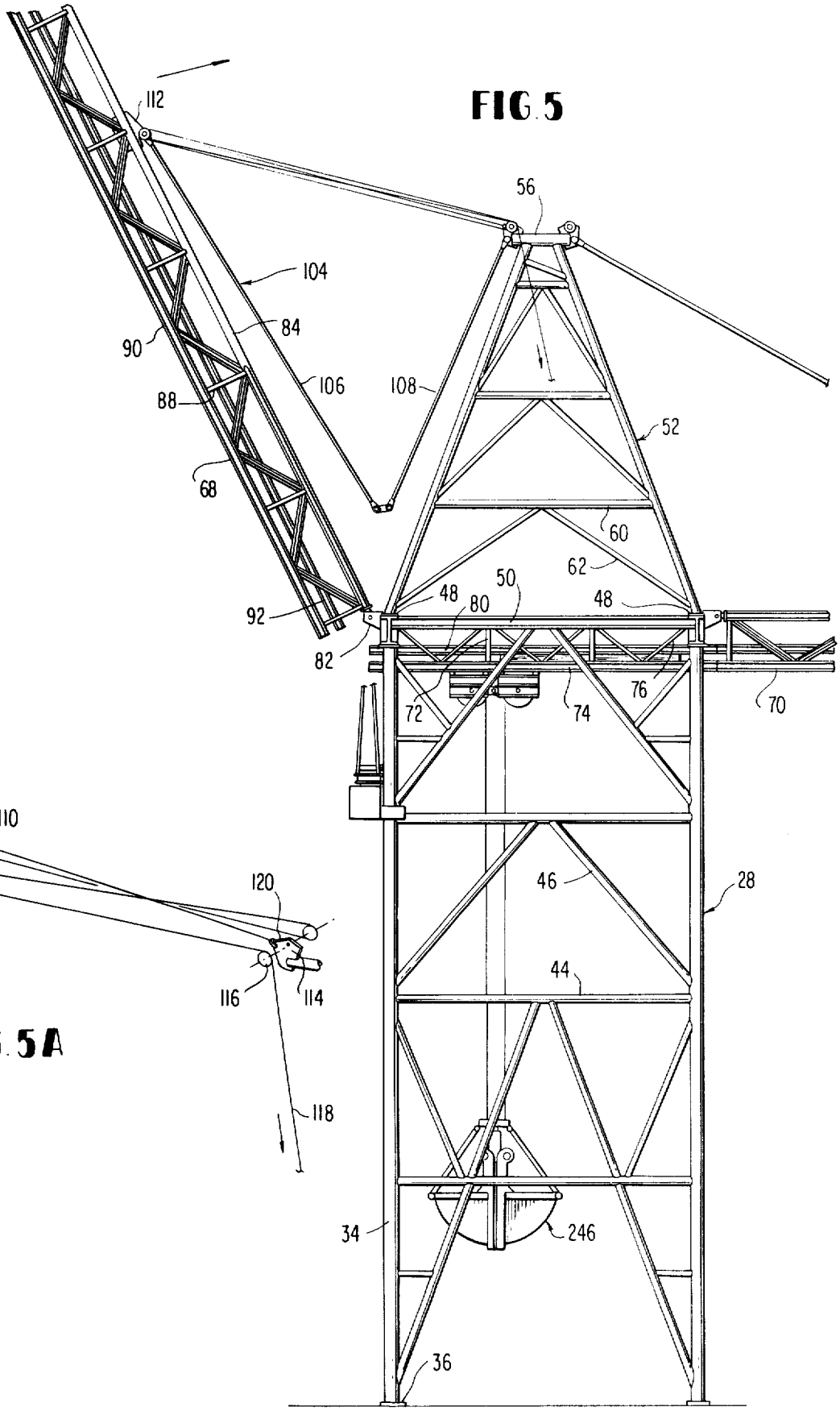
FIG. 5 is another partial side elevational view, showing one outer gantry section in elevated transport position.

Crane 20 comprises a tower 28 which includes spaced apart first and second vertical column assemblies 30 and 32 (FIG. 4). Each of these is composed of a plurality of inner and outer vertical structural posts 34 having base plates 36 secured to the deck of barge 22. The inner posts 34 are longer than the outer posts, and have respective top plates 38 to which the outer posts are also connected by angle braces 40. Reinforcing angle members 42 interconnect the inner and outer bars of each column assembly. Horizontal braces 44 with numerous angle struts 46 are spaced along the column assemblies between the vertical posts as required for strength and rigidity (FIG. 5). The top plates 38 of the first and second columns are spanned by a pair of transverse I beams 48 which are connected at their ends by longitudinal base structural members 50.

As shown in FIG. 4, an upper structure 52 of generally pyramidal form spans the columns 30 and 32. This upper structure has four main brace members 54 extending upwardly at converging angles from the inner corners of the columns, the upper ends of members 54 being joined by top side bars 56 and end bars 58. Reinforcing rails 60 and angle braces 62 also interconnect the main brace members 54.

Figure 7:
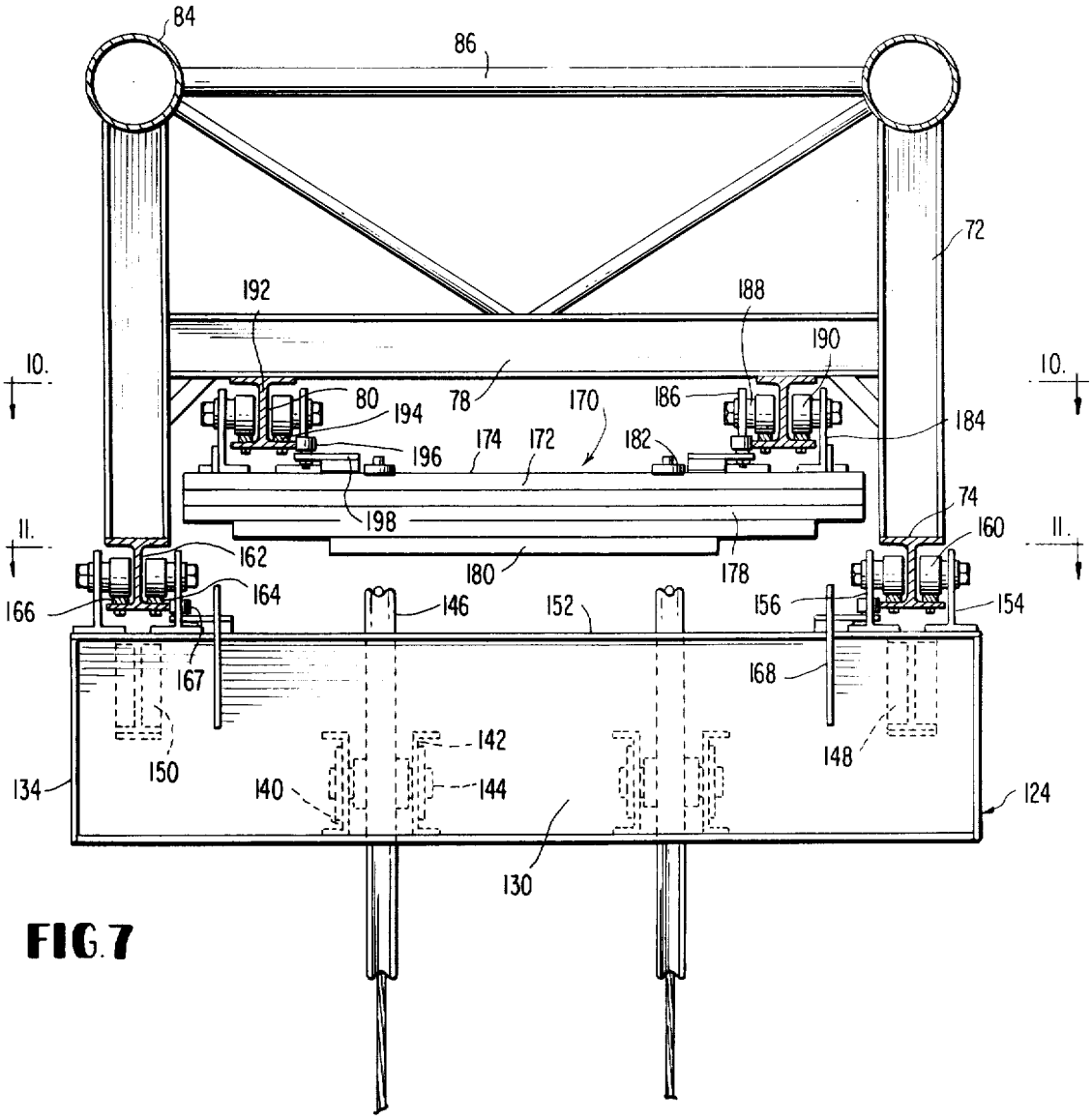
FIG. 7 is an enlarged vertical cross-sectional view through the gantry.

Extending between the columns 30 and 32 and below the upper structure 52 is a gantry assembly 64 which provides for mounting of the lift and counterweight mechanisms, and for the movement thereof. The gantry assembly has three sections, including a fixed central section 66 and first and second outer sections 68 and 70. The central section 66 has, as seen in FIGS. 3, 5 and 7, a series of vertical bars 72, which depend from the longitudinal base structural member 50 and to which are fixed a pair of lower longitudinal track members 74 in the form of I beams described in more detail below. Rigidifying braces 76 further secure the I beams to the structural member 50. Secured between vertical bars 72 are transverse beams 78 to which are affixed a pair of upper track members 80, again in the form of I beams.

Figure 6:
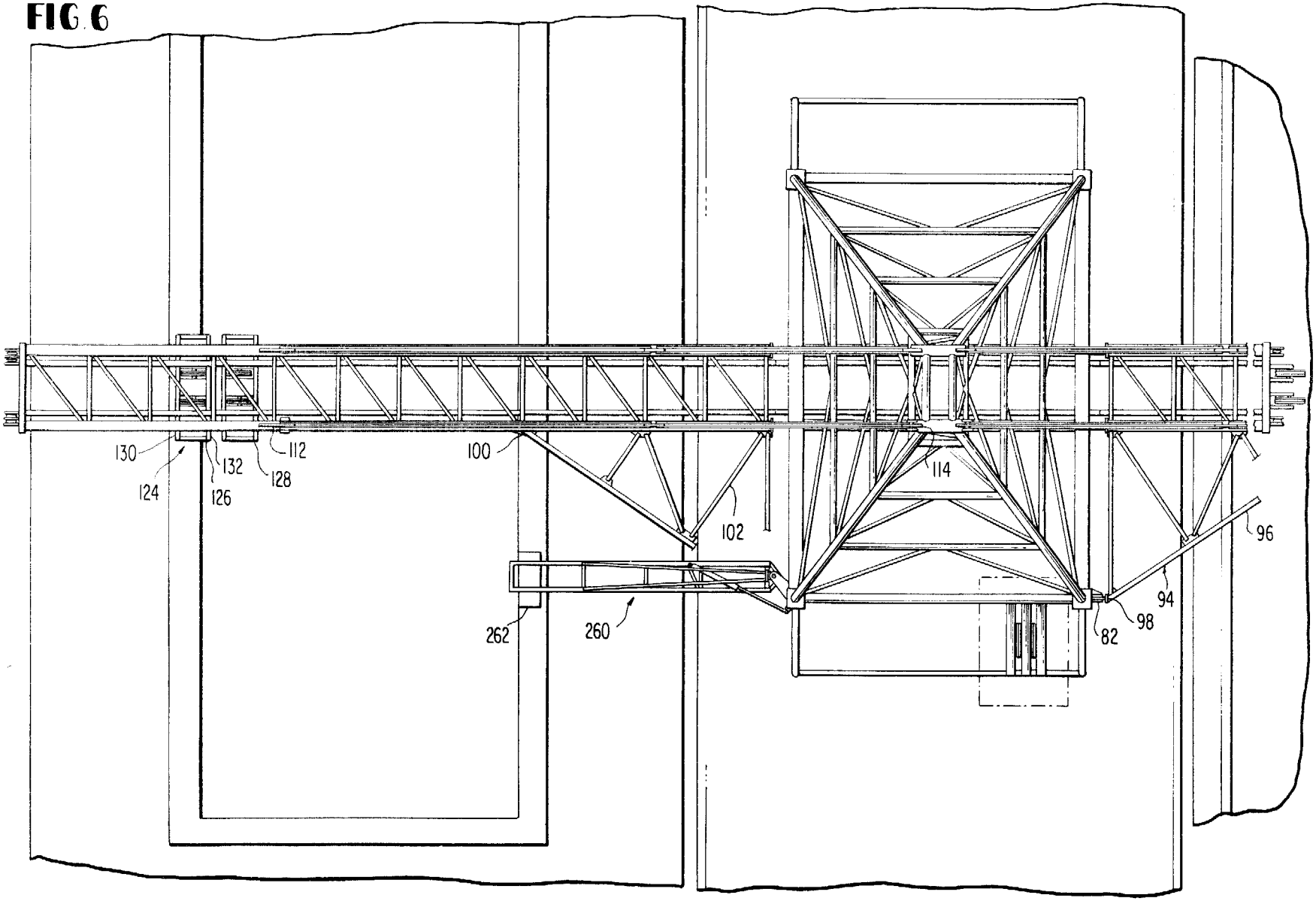
FIG. 6 is a foreshortened top plan view.

At two of the corners of the tower enlarged hinge plates 82 are provided. The outer gantry sections 68 and 70 each have tubular top bar members 84 with transverse cross rods 86 at spaced intervals. Vertical bars 88 depend from these, and are fixedly secured to lower I beam track members 90. At mid-length locations, the bars 88 have cross beams 78, and upper tracks 92 are suspended therefrom. Arm assemblies (FIG. 6) include angle braces 96 with hinge plates 98 pivotally secured to the respective hinge plates 82. The distal extremities 100 of the braces 96 are fixedly secured to the top bar member 84, and a series of cross bars 102 further interconnect the same. The top bars 84 are pivotally connected to the corresponding bars of the central gantry section by appropriate hinge members, not shown in detail.

Tension members 104 are provided for the outer gantry sections, and each comprises a first elongated bar 106 pivotally connected at one end thereof to an outer gantry section adjacent its outer end. A second bar 108 is hingeably secured at one end thereof to the first bar, and is pivotally connected at its opposite end to a side bar 56, whereby each of the tension members is articulated intermediate its ends to permit folding upon elevation of its associated outer gantry section.

Figure 5A:
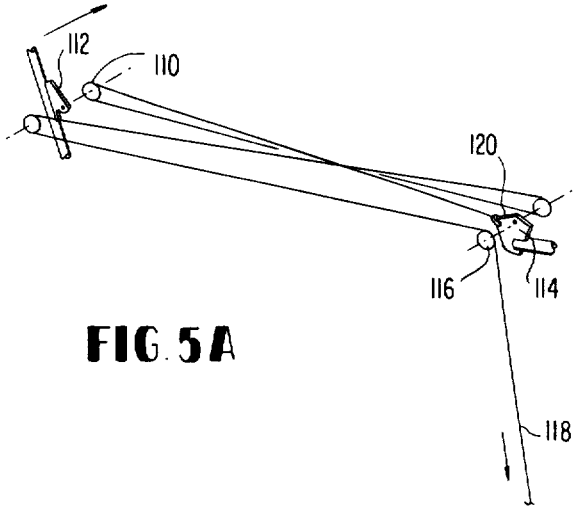
FIG. 5A is a diagrammatic representation of the tilt means for the gantry sections.

As indicated above, the outer gantry sections are designed for movement between operational and transport positions. In operational position, the track members of the outer sections abut, and are in longitudinal alignment with, those of the central gantry section. In FIGS. 5 and 5A, the means for rotating each of the outer gantry sections to its elevated position is shown. Such means comprises a pair of idler pulley wheels 110 rotatably mounted on brackets 112 on the top bar member 84. Aligned brackets 114 on the end bars 58 of the upper structure of the tower have idler pulley wheels 116, and cables 118 are trained about the respective idler pulley wheels, and are anchored at one end to the bracket 114, as at 120. The other ends of the cables 118 are engaged on winches 122 which function to take up or pay out the cables. As a cable is taken up on the winch, the corresponding outer gantry section is drawn upwardly to a substantially vertical transport position, the tension member 104 folding as shown at the port side in FIG. 5. Pay out of cables results in gravitational movement of the outer section to a horizontal operational position until the tension member limit is reached, at which point the tracks in the central and outer gantry sections are aligned.

Figure 12:
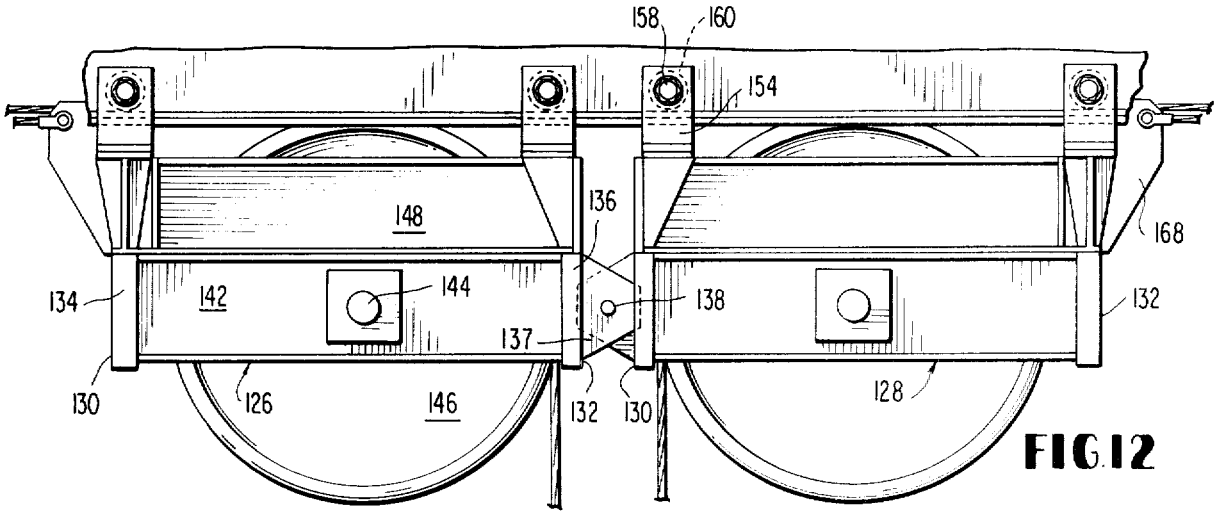
FIG. 12 is a side view of the lift trolley.
Figures 13, 14:
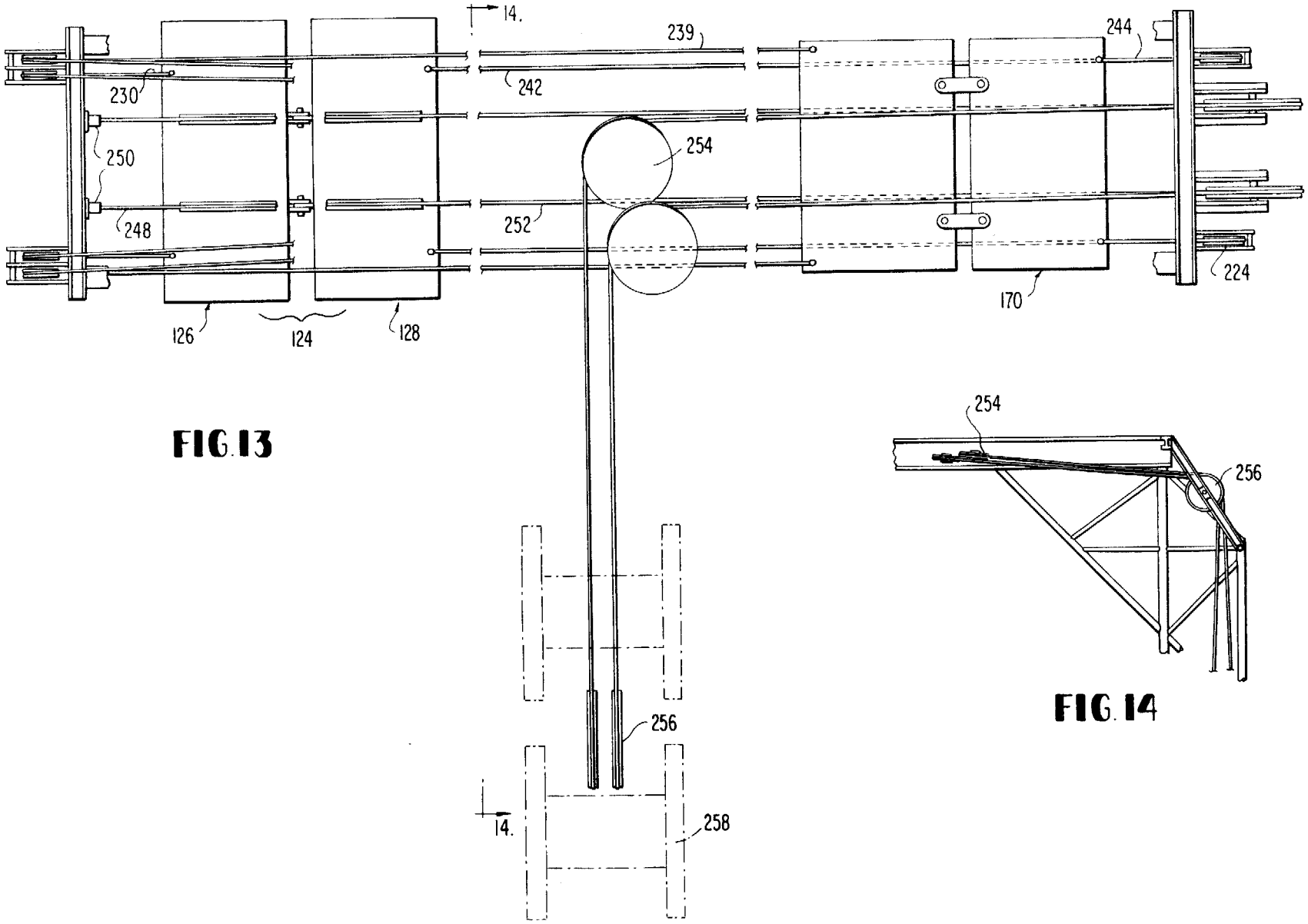
FIG. 13 is a partial diagrammatic representation of the cable and sheave system for moving the lift trolley and counterweight, and for raising and lowering of the bucket associated with the lift trolley.
FIG. 14 is a further diagrammatic view of the hoist cable and related components.
Figure 15:
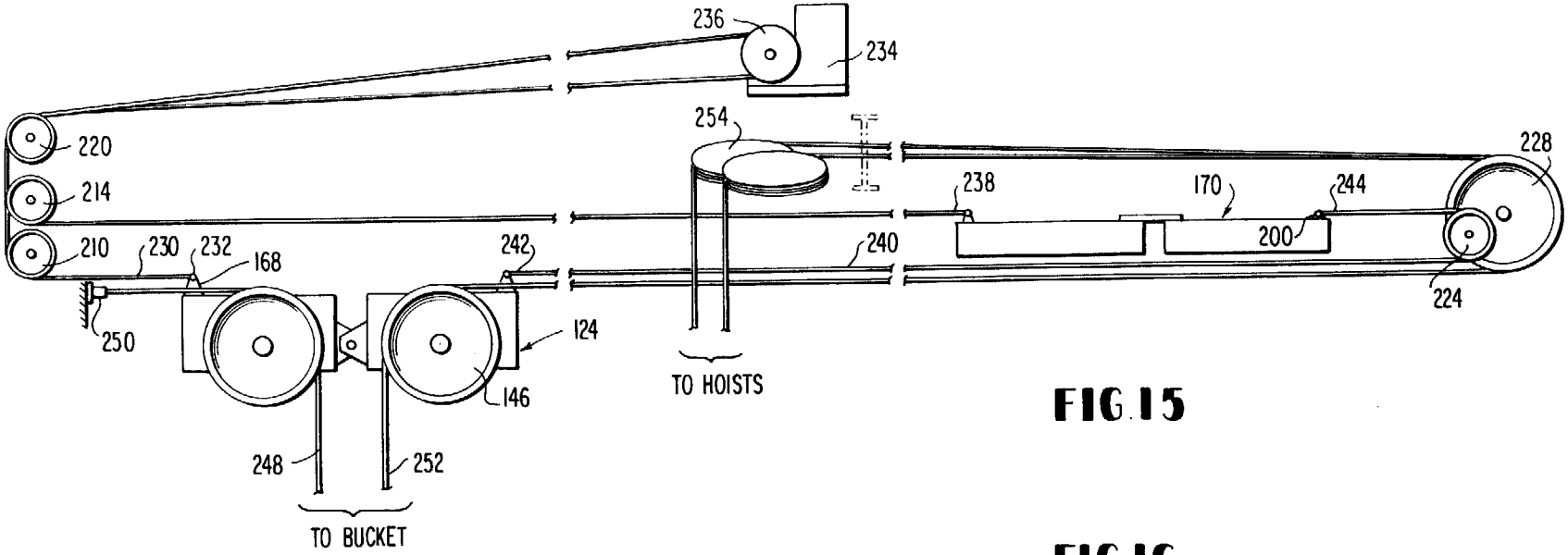
FIG. 15 is a still further diagrammatic view showing the cable and sheave system as disclosed in FIG. 13.

A bucket trolley assembly 124 (FIGS. 6, 7 and 12) comprises a pair of substantially rectangular housings 126 and 128. Each of these includes front and back plates 130, 132 and end blocks 134, 136. As illustrated in FIG. 12, the adjacent plates 132 and 130 have clevis plates 137 with a pin 138 extending therethrough so that the housings are connected to one another for travel together. Fixedly mounted within each of the housings are two laterally spaced pairs of longitudinally extending channel members 140, 142. Axles 144 are mounted therebetween and carry enlarged idler pulley wheels 146. Secured on the block 134 are longitudinal interior I beams 148, 150 which support top plates 152. Mounted on the corners of the housings on the plates 130 and 132 are pairs of inverted T members 154, 156. Projecting from each of these inverted T members is a stub axle 158 having a caster wheel 160 rotatably mounted thereon. As indicated above, the track members 74 comprise I beams, and consequently each includes a central rib 162 and lower ledges 164, 166 on either side thereof. The caster wheels 160 ride on the ledges, thereby supporting the trolleys for longitudinal movement on the gantry section. Guide rollers 167 are provided on the plates 152, and contact the adjacent beam sides.

In FIG. 12 it will further be noted that the leading and trailing sides of each trolley housing have a pair of plates 168 thereon, functioning as described below.

Figure 10:
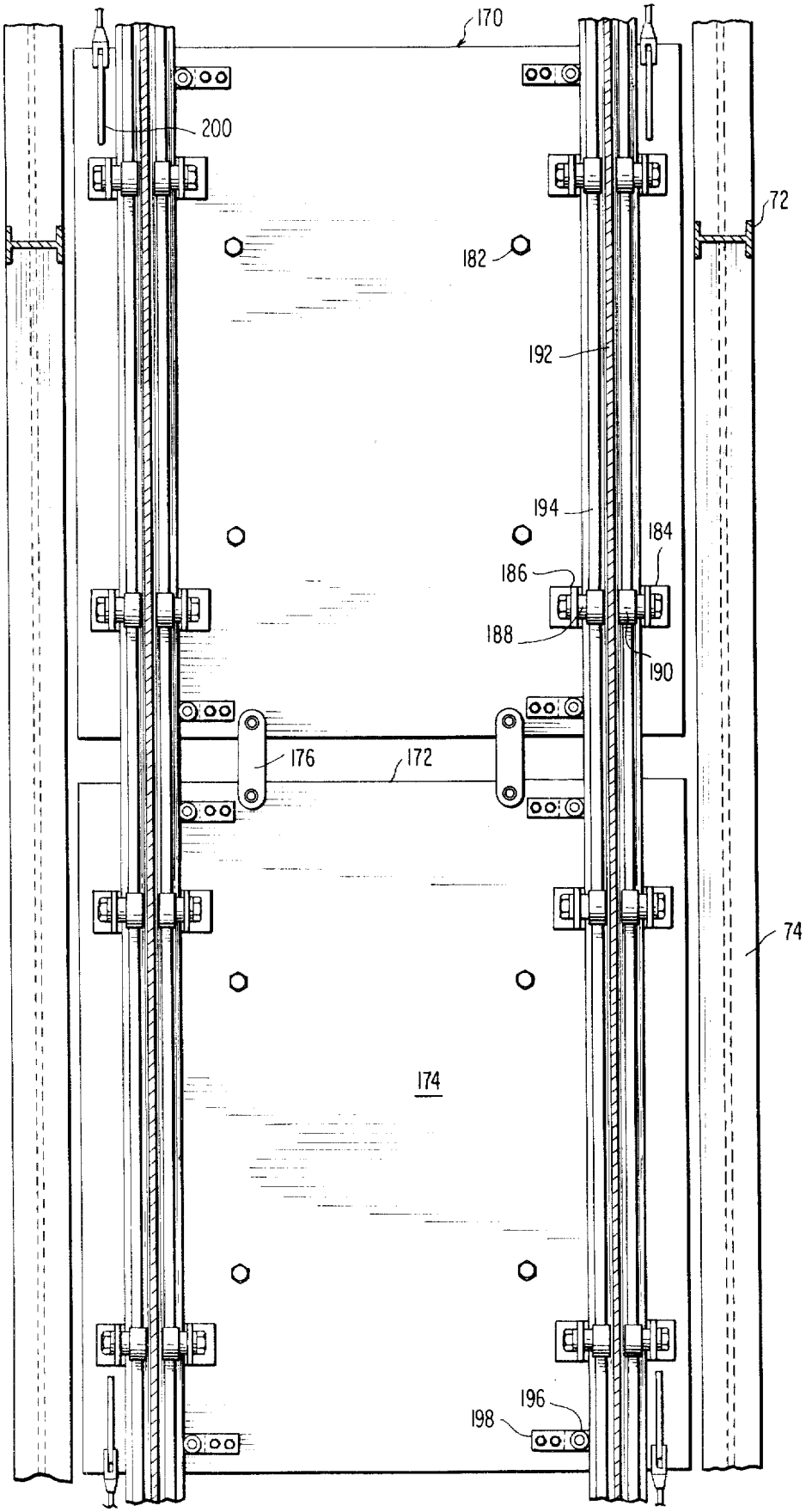
FIG. 10 is an enlarged sectional view showing the counterweight from above in detail.
Figure 11:
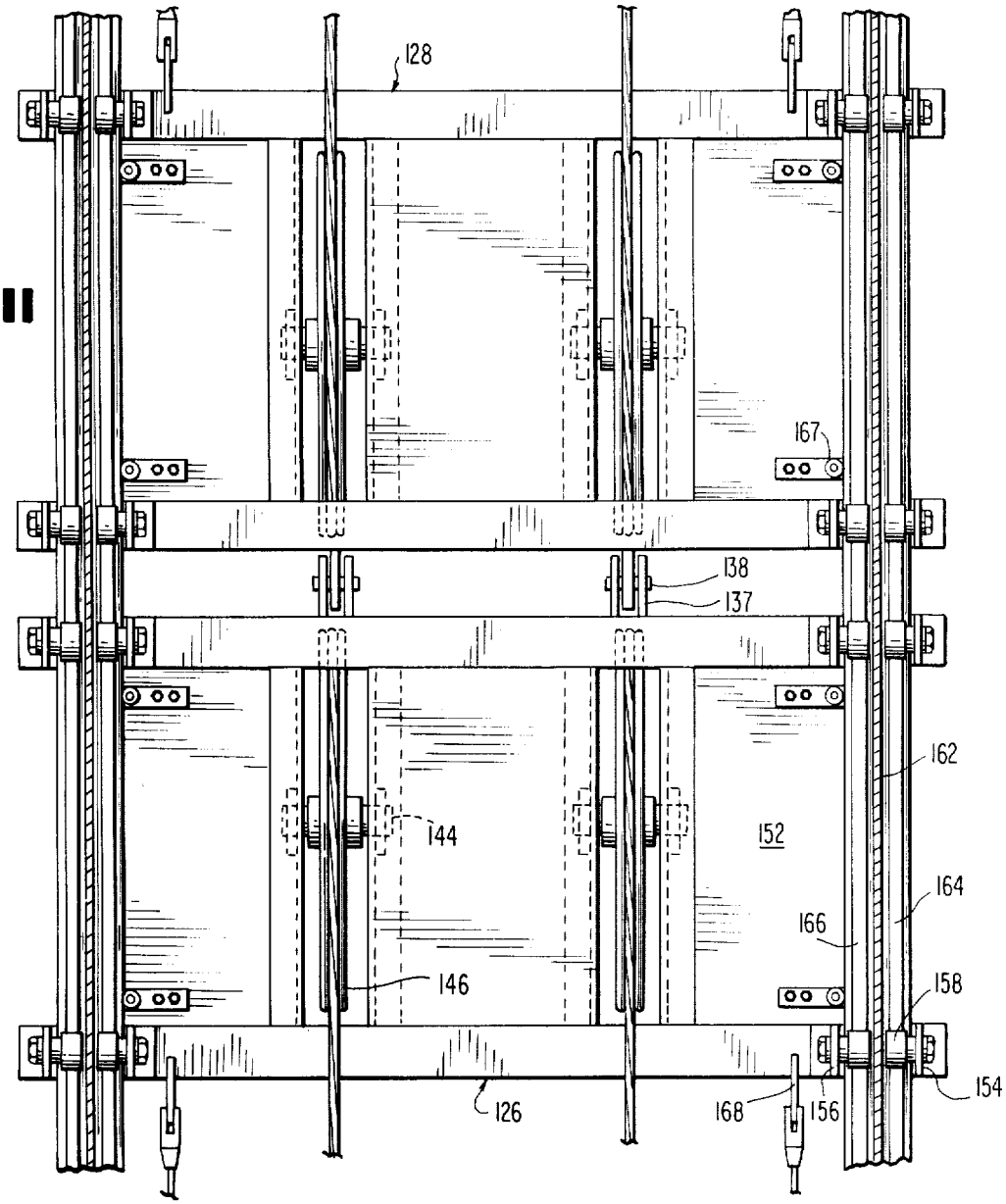
FIG. 11 is an enlarged sectional view disclosing the upper side of the lift trolley.

The movable counterweight assembly 170 (FIGS. 7 and 10) comprises two sets of metallic plates each including a top plate 172 of substantially rectangular flat form having an upper surface 174. The two top plates are connected by links 176, and a selected plurality of intermediate plates 178 and a lower plate 180 are secured by changeable fasteners which extend therethrough and through the intermediate plates to be held by a nut 182 or the like on top of the top plate. The number of plates, and the weight thereof, is dictated by the requirement that the counterweight assembly be substantially equal in weight to the weight of the trolley assemblies 124.

Secured to the upper surface 174 of the top plates 172 are a plurality of pairs of brackets 184, 186, each having an inwardly directed axle 188 with a rotatable caster 190. The I beam track members 80 each include a central rib 192 and lower ledge members 194, and the casters 190 ride on the ledge members. Travel of the counterweight is stabilized by the guide rollers 196 mounted on brackets 198 positioned at appropriate locations inboard of the tracks 80. Ribs 200 are provided at the leading and trailing ends of the top plates.

Figure 8:
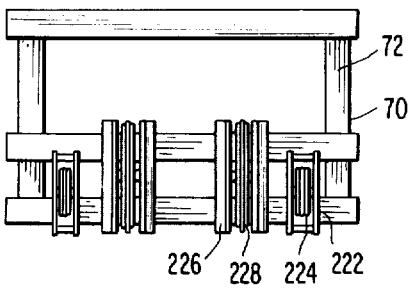
FIG. 8 is an elevational view at one end of the gantry.
Figure 9:
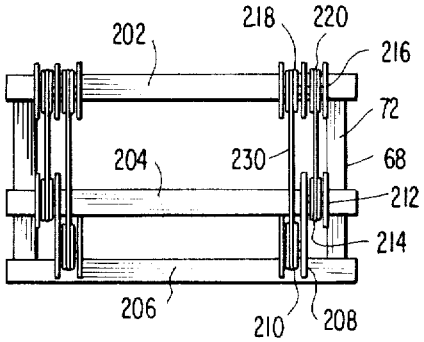
FIG. 9 is that of the opposite end of the gantry.

Referring to FIGS. 8, 9, 13 and 15, it will be noted the outer ends of the first and second outer gantry sections 68 and 70 differ in respect to the equipment mounted thereon. Each has outer end cross bars including top bar 202, a center bar 204 and a bottom bar 206. Mounted on the bottom bar 206 of the first section 68 are sheave brackets 204 with pulley wheels 210 rotatably mounted therein. Spaced above these on the center bar 204 of said end are sheave brackets 212 having pulley wheels 214, and above these on the top bar 202 are a pair of double sheave brackets 216, each having two pulley wheels 218, 220 rotatably mounted therein. The wheels 220 are herein denoted the outer wheels and, as shown in FIG. 9, are vertically aligned with the wheels 214. The inner wheels 218 are vertically aligned with the pulley wheels 210.

On the second outer gantry section 70, FIG. 8, the lower bar 206 has sheave brackets 222 with pulley wheels 224, and inboard of these are large sheave brackets 226 which extend from the bottom bar to the center bar and which have large pulley wheels 228 rotatably mounted therein.

A cable system interconnects the bucket trolley assembly 124 and the counterweight assembly 170 for concurrent movement. A pair of first cables 230 have first ends 232 secured in the plates 168 on that end of the trolley assembly 124 which is directed toward the first gantry section 68. These cables are first trained about the pulley wheels 210, over the wheels 218, and from there to a drive winch 234 located on the top structure. The winch 234 has a drum 236, and the cable 230 is wound about the drum and reverted therefrom back in the direction of the same gantry section end, where it passes over the sheave 220 and about the pulley wheels 214, extending back to anchorage at its ends 238 on the ribs 200 of the counterweight which are directed towards said first gantry section.

Second cables 240 are anchored at their first ends 242 to the plates 168 of the lift trolley assemblies which are in the direction of the second gantry sections. These cables extend about the pulley wheels 224 and are secured at their second ends 244 to the ribs 200 on corresponding ends of the counterweight.

As appears from the above, operation of the winch 234 to turn the drum 236 results in simultaneous movement of the lift trolley and counterweight in opposite directions.

The lift trolley assembly 124 is employed in load handling and transfer, and has, illustratively and by way of example, a clamshell bucket 246. This is employed in the disclosed environment of use in transfer of materials from the vessel to the barge, and the lift trolley bypasses the counterweight in such function. First control cables 248 for the raising and lowering of the bucket are secured at their ends 250 to the gantry, and extend about one of the idler wheels 146 to the bucket. Second cables 252 extend from the bucket, about the other idler wheels 146 to the large sheave 228 on the second end of the gantry section. From such position, the cables are trained about wheels 254 mounted on the column structure (FIGS. 13 and 14), and over wheels 256. The wheels 256 are vertically aligned with a drum winch 258 which functions to take up or pay out the cable to raise or lower the bucket.

Figure 16:
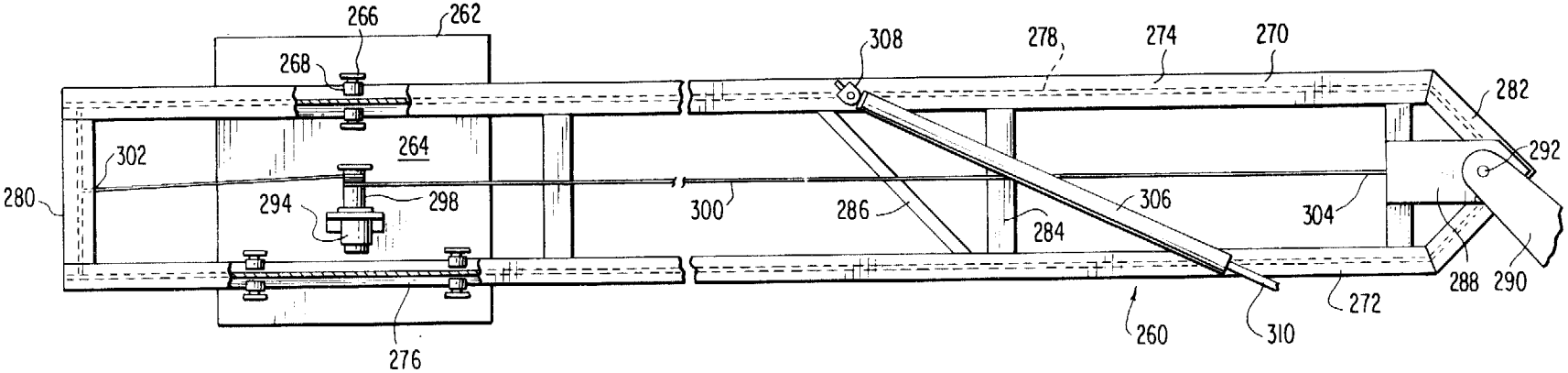
FIG. 16 is a top view of the cab boom.

A further new and novel feature of the invention concerns the mounting and operation of the operator's cab. The cab and its mounting arm assembly are generally identified in the drawing by reference numeral 260. In FIG. 16, it will be noted that the cab 262 has a roof 264 with a series of brackets 266 thereon. Each bracket has a caster wheel 268 rotatably mounted thereon, the caster wheels being arranged in closely spaced pairs. A pair of heavy I beam members 270, 272 of elongated form each have a top plate 274, a base plate 276 and a central rib 278. The base plates provide ledges, and the caster wheels 268 are mounted to ride on these ledges. The beam members are joined at their distal extremities by a cross beam 280, and at their proximal ends by an apex member 282. At intermediate points, the distance relation between the I beam members is maintained by cross slats 284, which are above the ledges, and angle bars 286. Extending from the apex member 282 to the next adjacent one of the cross slats is a pivot block 288. A foot member 290 extends from the column, and a pivot pin 292 pivotally connects the pivot block 288 to the foot member 290.

Mounted on the roof 264 of the cab 262 is a winch 294 having a winch winding drum 298. A cable 300 is anchored at its outer end 302 to the cross bar 280, and at its opposite interior end 304 to the pivot block 288, and is trained about the drum 298. The operation of the winch is controlled from within the cab. Actuation of the winch to turn the winding drum causes the cab to be propelled inwardly or outwardly along the support arm. This permits optional inward or outward positioning of the cab according to the needs of the operator to view the load being handled.

The cab is further adapted for lateral pivoting movement through a hydraulic cylinder 306 pivotally mounted on a clevis 308 on the I beam 270, and having an extendible and retractible ram 310 pivoted to the column. Thus, the operator may further adjust his position so as to maintain visual contact with the load and/or its area of deposit at all times.

I claim:

1. An adjustable balance crane comprising:

a platform having an upper deck;

a tower assembly comprising first and second upright column assemblies extending vertically from the platform above the deck in laterally spaced apart relationship to one another;

the tower assembly further comprising an upper structure spanning and fixed to the column assemblies, said upper structure including top bars, and including a fixed central gantry section which extends between the column assemblies;

the fixed central gantry section having opposite end portions which extend outwardly of the column assembly;

an operator's cab assembly, including a cab and a mounting arm, the mounting arm being horizontally pivotally connected to the first upright column assembly for lateral pivotal movement with respect thereto, and the cab being movable inwardly and outwardly along the mounting arm;

first and second outer gantry sections, each including an inboard end and an outboard end, the inboard ends being vertically upwardly pivotally connected to the respective end portions of said fixed central gantry section;

the gantry sections each having at least two vertically disposed longitudinally extending track means thereon, the respective track means of the sections being horizontally aligned;

a bucket trolley movably mounted on the lower of said track means, and a counterweight trolley movably mounted on the upper of said track means;

articulated support tension members pivotally connected to and extending from the top bars of the upper structure to and hingeably secured to the outboard ends of the outer gantry sections;

cable means for pivotally moving the outer gantry sections from horizontal operating positions aligned with the fixed central gantry section to generally upward vertical transport positions; and a cable and sheave system for simultaneously adjusting the relative positions of said bucket trolley and said counterweight trolley on said vertically disposed track means in opposite directions.

2. The crane of claim 1, wherein:

the bucket trolley has at least two cable end retainers thereon;

the counterweight trolley has at least two cable end retainers thereon;

the cable end retainers are located adjacent the opposite ends of the trolleys;

the outboard end of the first outer gantry section has a series of idler sheave wheels thereon, and outboard end of the second outer gantry section has a series of idler sheaves;

a first fixed length cable secured to the cable end retainer on the bucket trolley, trained over an idler sheave on the outer end of the second gantry section, and fixedly secured to a corresponding end of the counterweight trolley; and a second fixed length cable secured to a cable end retainer on the bucket trolley, trained about an idler sheave on the outboard end of the first gantry, wound about a cable drive winch drum, and fixedly secured to a cable and retainer on the counterweight trolley.

3. The crane of claim 1, wherein the platform rests on a medium.

4. The crane of claim 1, further comprising:

buckets suspended from the left trolley the lift trolley comprising a pair of rectangular housings connected together;

two pairs of idler lift pulley wheels one each secured within the rectangular housings;

a lift winch on the first upright column assembly; and cable means extending from the lift winch and trained about the lift pulley wheels and connected to the bucket.

5. An adjustable balance crane comprising:

a platform;

a tower assembly including upright, spaced apart columns secured to the platform and an upper structure spanning the columns;

a central fixed gantry section extending from the upper structure and extending horizontally between the columns;

outer gantry sections, each having an inboard end and an outboard end, the respective inboard ends being pivotally secured to the opposite sides of the fixed central gantry section, said outer gantry sections being vertically upwardly pivotal only on said pivot;

each of said gantry sections having vertically disposed track means, including at least a lower track and an upwardly spaced top track;

a load trolley assembly movably mounted on the lower track and a counterweight trolley assembly movably mounted on and suspended from the upward track; and a cable and sheave system, including a winch for simultaneously moving the trolleys in opposite directions on the upper and lower tracks whereby the lift trolley bypasses below the counterweight trolley during movement of the lift trolley between extreme ends of the gantry sections.

6. The crane of claim 5, further comprising an operator's cab assembly, including a cab and a mounting arm, the mounting arm having means for horizonally pivotally moving the arm laterally with respect to the tower assembly, and means for moving the cab inwardly and outwardly along the mounting arm.

7. The crane of claim 5, wherein:

the upper and lower tracks comprise I beams; and the load trolley assembly and the counterweight trolley assembly each movably suspended from the I beams by casters rotatably mounted on the trolleys.

8. The crane of claim 5, wherein:

the counterweight trolley assembly comprises a series of elongated, substantially rectangular plates secured together and including a top plate;

the top track means on each gantry section comprises a pair of longitudinally extending I beams each having a vertical center web and top and bottom horizontal flanges, the bottom flanges providing ledges on either side of the vertical center web;

brackets fixedly secured to said top plate in pairs, with one bracket of each pair adjacent each of the ledges; and a caster wheel on each bracket riding on the adjacent ledge.

9. The crane of claim 5, further comprising:

a pair of interconnected pulley housings in the load trolley assembly; and hanger brackets projecting upwardly from said housings;

trolley wheels on each of said hanger brackets;

said upper and lower tracks comprising longitudinally extending I beams each having at least one ledge thereon, the I beams being connected to the respective gantry sections; the inboard ends of said sections abutting and in alignment with said fixed central section; and the trolley wheels being engaged on the ledges.

10. The crane of claim 5, wherein the weights of said trolley assemblies are substantially equal, said cable and sheave system being coupled to said trolleys such that movement of said load trolley assembly in one direction automatically causes an equal movement of said counterweight trolley in the opposite direction, and said lift trolley bypassing below said counterweight trolley upon movement of said lift trolley between extreme ends of the gantry sections.

* * * * *